United States Patent [19]

Schlapfer et al.

[11] Patent Number: 5,061,573

[45] Date of Patent: Oct. 29, 1991

[54] METHOD OF MAKING A METAL ALLOY STRIP AND A STRIP MADE THEREBY

[75] Inventors: Hans-Walter Schlapfer, Rickenbach; Bruno Sonderegger, Schottikon; Werner Straub, Oberstammheim, all of Switzerland

[73] Assignee: Sulzer Brothers Limited, Winterthur, Switzerland

[21] Appl. No.: 301,623

[22] Filed: Jan. 25, 1989

[30] Foreign Application Priority Data

Feb. 1, 1988 [CH] Switzerland ..... 0341/88

[51] Int. Cl.[5] ..... C22C 32/00

[52] U.S. Cl. ..... 428/614; 428/606

[58] Field of Search ..... 428/614, 606

[56] References Cited

U.S. PATENT DOCUMENTS

| | | | |
|---|---|---|---|
| 4,540,546 | 9/1985 | Giessen | 420/590 |
| 4,786,467 | 11/1988 | Skibo et al. | 420/590 |
| 4,800,065 | 1/1989 | Christodoulou et al. | 420/590 |

FOREIGN PATENT DOCUMENTS

| | | |
|---|---|---|
| 0002785 | 7/1979 | European Pat. Off. . |
| 0148306 | 7/1985 | European Pat. Off. . |

*Primary Examiner*—R. Dean
*Assistant Examiner*—David W. Schumaker
*Attorney, Agent, or Firm*—Kenyon & Kenyon

[57] ABSTRACT

The metal strip which is made in the form of a foil has hard particles in the form of plenary deposits from a melt included in a metal matrix which has solidified in vitreous form and/or which is microcrystalline. At least 50% of the hard particles have a skeletal crystal shape with a length to width ratio of at least 5. The hard particles are securely adhered within the metal strip.

5 Claims, 1 Drawing Sheet

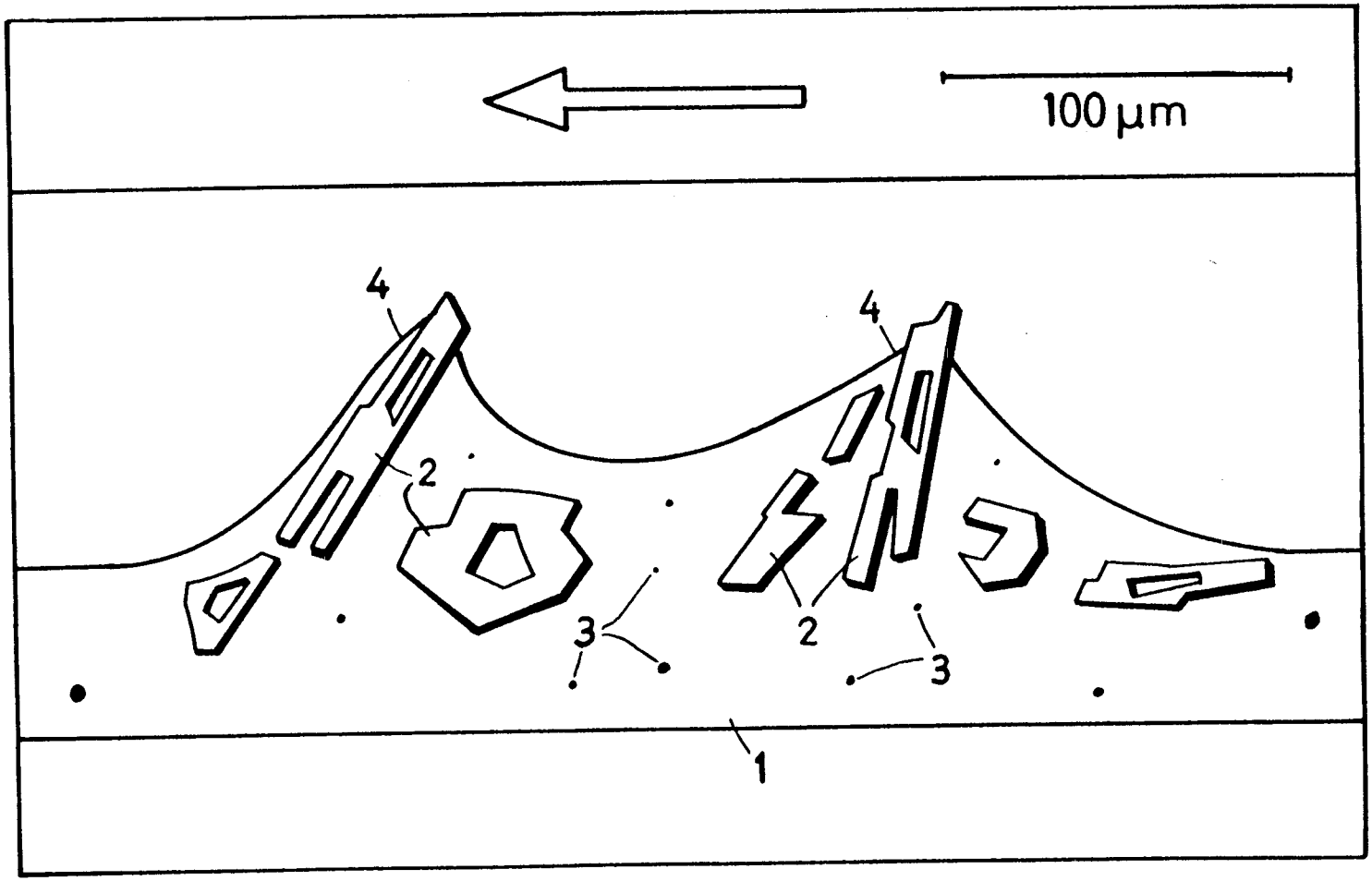
100 µm
4
4
2
2
3
3
1

METHOD OF MAKING A METAL ALLOY STRIP AND A STRIP MADE THEREBY

This invention relates to a method of making a metal alloy strip and to a strip made thereby. More particularly, this invention relates to a method of making a metal strip in foil form as well as a metal strip of foil form.

Various techniques have been known for producing metal alloy strips. For example, European Patent Application 0148306 describes a method of producing a metal alloy strip suitable for a magnetic tape medium. As described, in order to produce the strip, a melt of molten metal or metal alloy containing iron is solidified so that equiaxed iron or iron alloy particles are distributed substantially homogeneously throughout the solidified base metal matrix. The solidified mixture may then be cold rolled into a thin strip so that the iron particles together with the matrix elongate.

European Patent Application 0002785 describes a method of forming a strip of metallic glass containing embedded particulate matter, for example for use as an abrasive grinding tape. As described, finely divided particulate matter is cast with a molten glass-forming alloy into an amorphous metal strip. As described, use is made of a melt spin process employing a pressurized orifice which permits manufacture of the metal strip directly from the melt. During this process, the particulate matter in the casting operation is to rise to the top surface of the strip being cast so as to protrude from the surface while being anchored within the metal matrix. In such a process, hard particles, for example metal borides, carbides or oxides, are added in granular form to the melt or may be obtained directly as primary deposits by chemical reactions of individual components of the melt.

It has now been found that the adhesion of the hard particles in a metal strip formed in accordance with the process described in European Patent Application 0002785 is, in some cases not adequate, particularly if the strip is to be used as an abrasive material for the surface treatment of solids.

Accordingly, it is an object of the invention to improve the adhesion of hard particles in a metal matrix for the formation of an abrasive strip.

It is another object of the invention to provide an improved method of making metal strips for use in abrasive equipment and tools.

Briefly, the invention provides a metal alloy strip which is comprised of a metal matrix and hard particles which are disposed in a surface zone of the metal matrix having a thickness of 0.01 to 0.5 millimeters. In accordance with the invention, at least 50% of the hard particles have a skeletal crystal shape with a length-to-width ratio of at least five (5). The third dimension is nearly equal or less than the width.

As in the known strip, the hard particles concentrate mainly at the free surface of the strip which solidifies with a vitreous or microcrystalline structure. The hard particles form a rough surface.

Due to the skeletal nature of the hard particle crystals, the structure of which differs considerably from a spherical form and which can engage within the metal matrix, for example, by undercut portions, the adhesion of the crystals within the matrix is increased.

The elements which are used for the metal matrix may consist of at least one element of the Group VIIIA; at least one element of the groups IVA, VA and VIA, and at least one of boron, carbon, silicon and phosphorus. In addition, the particles with the skeletal crystal shape constitute 70% of the total of the hard particles.

The invention also provides a method of making a metal strip wherein a melt is first obtained of the metals noted above. Thereafter, the melt is solidified while permitting hard particles of the indicated elements to separate from the remainder of the melt in order to form a prealloy. The resulting solidified prealloy melt is then remelted and held for a predetermined time and thereafter fired against a rotating wheel, for example in a manner as described in U.S. Pat. No. 4,540,546, to form a solidified continuous strip.

In accordance with the method, an empirically determined "energy influence" dependent on the temperature of the remelted prealloy and the holding time is maintained under a maximum value on the remelted prealloy to at least partly prevent re-dissolution of the hard particles.

In addition, the speed of solidification of at least one of the prealloy melt and the solidified strip is varied in order to control the roughness of the free surface of the strip. The roughness is determined by the size and/or position (angle of incidence) of the hard particles.

The metal strip which is produced may be primarily used as a sanding or emery "paper" or as an abrasive coating on files and cutting wheels where the strip can be used, for example, as a replacement for diamond tools. Another range of application is in the use of the strip as a keying layer for adhesives, such as for clutch linings. It is also possible to use the strip as a flexible strip for welded coatings or as a starting material for laser coatings. Further, the strip may be used for making hard substance powders by dissolving the metal matrix. Of course, other applications are possible in cases in which a rough surface of maximum hardness and good adhesion of the hard substances is required.

Advantageously, for the use of the strip as an abrasive structure, the surface provided with the hard particles has a rough structure with projecting peaks, at least approximately 100% of the peaks containing hard particles.

The method of making the strip is characterized in that the metallurgical parameters relating to the melt in the separate production of the prealloy—such as the melt atmosphere, chemical composition, overheating of melt before pouring, casting temperature and/or solidification speed—are so selected that the hard particles separate from the melt during the actual solidification of the prealloy. Also, during the production of the strip, the empirically determined energy influence on the melt of the remelted prealloy is limited to a maximum value, such influence being a function of the melt temperature and the time until melt solidification, for which maximum value re-dissolution of the hard particles is at least partly prevented.

The "energy influence" to be taken into account in the production process is a relatively complex function of the temperature of the remelted prealloy melt and the time during which the prealloy is in the liquid phase. The complexity of the functional relationship of the two variables necessitates this "energy influence" being determined empirically by preliminary experiments for the production of a strip. The energy influence should be determined afresh for each strip composition and for different particle sizes of the included hard particles. The relationship is found to be such that for a given dissolution of the hard particle crystals in a given metal matrix only relatively short times are required with relatively high melt temperatures or relatively long times with relatively low temperatures.

The "energy influence" can clearly be described rather as the ability of the remelted liquid phase to redissolve the hard particles included therein.

The size of the hard particles and hence the roughness of the free surface of the strip can be controlled by varying the solidification speed in the production of the prealloy and/or of the strip, solidification of the prealloy being influenced mainly by the material and diameter of the casting chill molds and the strip solidification being determined particularly by the strip speed on a heat-dissipating centrifugal wheel or strip. The circumferential speed of the wheel can vary between 500 and 3000 meters/minute.

Advantageously, melting of the prealloy and its remelting before production of the strip are effected in a protective gas atmosphere, e.g. an argon (Ar) atmosphere. The production of the prealloy may be carried out in known manner at a reduced pressure. Also, a cooling rate of at least 100 K/sec is maintained during production of the strip from the melt. Boron, carbon, silicon and phosphorus act as vitrifiers in known manner in these conditions; their effect can be intensified by an optional addition of sulphur, gallium, germanium, arsenic, tin and/or antimony.

These and other objects and advantages will become more apparent from the following detailed description taken in conjunction with the accompanying drawing which schematically illustrates a part cross-sectional view made from a highly magnified structural photomicrograph (magnification 500:1) of a rough metal strip manufactured in accordance with the invention.

Preparation of prealloy

Disregarding undesirable but inevitable impurities, such as, for example, aluminum (Al), manganese (Mn) or copper (Cu), a mixture was prepared in a total quantity of 300 grams (g) with the following composition in mass-%, corresponding to the values in atom-% shown in brackets:

Ni 73.8 (60.9); Cr 14 (13.1); Fe 4.5 (3.9); Si 4.5 (7.8) and B 3.2 (14.3).

Using an induction coil, this mixture was melted in a crucible having an aluminum (Al) silicate lining (mullite) to form the prealloy, a slight vacuum of about 130 mbar (100 mm Hg) being maintained in the crucible. The melting atmosphere was argon (Ar) having a purity of 99.998%.

The melt, the liquid temperature of which was measured at about 1380° C., was heated up to a temperature of about 1540° C. before pouring, this corresponding to about 160° C. overheating. The prealloy melt, which contains a eutectic-like residual melt having a lower solidus point of about 1060° C., is then poured into chill molds and solidified.

Since the size and shape of the hard particles which are in the melt and which, in the present case, consist predominantly of zeta-chromium boride ($\zeta$-CrB), depends on the speed of solidification of the prealloy—and can therefore to some extent be controllably varied by varying the solidification time—the optimal solidification speed for a required particle size and shape of the hard particle inclusions is determined experimentally by preliminary trials. The solidification speed depends primarily on the material and/or lining of the chill mold, and the diameter thereof. If pouring is carried out at a temperature of about 1420° C., for example, in a copper chill mold of a diameter of 20 to 24 millimeters (mm), solidification takes place in three to five seconds therein at a cooling speed of 1000° C./min, resulting in hard particle deposits of a length of about 10 to 20 $\mu$m. If, however, the copper chill molds are replaced by a steel chill mold lined with zirconium oxide ($ZrO_2$), having a diameter of 28 millimeters (mm), then slower cooling speeds of about 500° C./min are obtained under otherwise identical conditions, resulting in solidification times of 10 seconds. In that case the hard particles are deposited basically in the form of skeletal crystals having a length of about 0.3 millimeters (mm).

Preparation of metal strip

The metal strip is made in a known melt spinning device from the prealloy interspersed with the hard particles. The prealloy is re-melted in a quartz glass spinneret by means of induction coils surrounding the latter. The spinneret is disposed about a centrifugal wheel consisting of a thermally conductive material, e.g. a age-hardenable copper chromium alloy. Surface tension is prevented by movements of the melt bath and melt outflow is prevented by relatively low temperatures in the area of the spinneret outlet which is itself open. The heating-up time is so selected that the melting point of the alloy i.e., as already stated, about 1060° C., is reached after about 4.5 minutes, the quartz glass tube being flushed out with argon during heating up to about 950° C.

In order to obtain homogenization of all the prealloy melt, for example in respect of temperature and viscosity, the remelting operation must be followed by a certain holding time until a strip can be made from the remelted prealloy. This holding time depends on the "energy influence" explained hereinbefore, and may be 1 to a maximum of 5 minutes. For a melt temperature of 1060° C., the empirically determined energy influence shows that in the present example a melt holding time of about 1 minute is permissible after complete remelting of the prealloy.

On completion of the holding time, the remelted prealloy is "fired" against the centrifugal wheel by application of an argon pressure surge at 0.25 bar excess pressure to the surface of the melt. The speed of rotation or circumferential speed of the wheel influences the strip solidification time. Relatively high speeds result in strips in which the deposits are relatively coarse and/or project considerably from the strip plane, while relatively low speeds give fine-grain and/or flat hard substance particles in the metal matrix containing, in the present case, a percentage proportion of hard substance deposits in the form of 3–10% zeta chromium boride.

For the exemplified embodiment described, circumferential speeds of the centrifugal wheel of about 1100 meters/minute give mean roughness values Ra (DIN 4762) of 2.2–2.8 $\mu$m in the longitudinal direction of the strip and 1.3–1.8 $\mu$m transversely thereof on the strip surface remote from the wheel. If the circumferential speed of the wheel is increased to about 1300 meters/minute, the mean roughness Ra are 100–130 $\mu$m in the longitudinal direction and 60–100 $\mu$m in the transverse direction.

The single FIGURE, which is a cross-section through a relatively coarse metal strip, production of which has been described above, was drawn from a photograph which was made with a 500× magnification by means of an optical microscope.

The FIGURE shows hard particles 2, the crystal form of which may be designated skeletal, in an amorphously solidified vitreous metal matrix 1, which may, however, at least partially have a microcrystalline structure. Microcrystals 3 of hard substance are also visible in the metal basic material in addition to the skeletal crystals 2.

The FIGURE clearly shows peaks 4 "occupied" by hard particle crystals 2, these peaks forming at the free surface of the strip 1, which is at the top in the FIGURE, over 70% of the length dimension of the hard particles being embedded in the metal matrix in the example illustrated.

The irregular shapes of the crystals 2 solidified in skeletal form, comprising internal cavities, incisions, angle and edges, are the cause of the improved adhesion of the hard substances in the amorphous or microcrystalline structure of the metal strip.

The arrow in the FIGURE indicates the direction in which the strip 1 was hurled away from the melt spinneret by the centrifugal wheel during production.

The invention thus provides a metal strip in the form of a foil wherein hard particles are embedded in the roughened surface in a secure manner. The invention also provides a method of making an improved strip with a strip with a roughened surface.

The metal strip which is in foil form may of any suitable thickness as indicated by the relative sizes shown in the drawing. The thickness of the metal strip may vary, measuring between the smooth surface of the bottom and the peaks, between 0.01 to 0.5 millimeters (mm); in the strip of the FIGURE said thickness is about 0.1 to 0.15 millimeters (mm).

What is claimed is:

1. A metal alloy strip comprising a metal matrix; and hard particles disposed in a surface zone of said metal matrix, said zone having a thickness of 0.01 to 0.5 millimeters, at least 50% of said hard particles having a skeletal crystal shape with a length-to-width ratio of at least 5.

2. A metal alloy strip as set forth in claim 1 wherein said martrix consist of at least one element of the groups IV A, V A and VI A; at least one element of the group VIII A; and at least one of boron, carbon, silicon and phosphorus.

3. A metal alloy strip as set forth in claim 1 wherein said particles with said skeletal crystal shape constitute a minimum of 70% of said hard particles.

4. A metal alloy strip as set forth in claim 1 wherein said surface zone has a rough structure with projecting peaks, each said peak having at least one hard particle therein.

5. A metal alloy strip as set forth in claim 4 wherein each particle of said hard particles projecting from said matrix has at least 70% of the length thereof embedded in said matrix.

* * * * *